United States Patent [19]

Hasegawa et al.

[11] Patent Number: 4,555,467

[45] Date of Patent: Nov. 26, 1985

[54] DEVELOPER HAVING IMPROVED FLOW CHARACTERISTICS AND A PROCESS FOR PRODUCING SAME

[75] Inventors: Tetsuo Hasegawa, Tokyo; Koushi Suematsu, Kawasaki, both of Japan

[73] Assignee: Canon Kabushiki Kaisha, Tokyo, Japan

[21] Appl. No.: 558,702

[22] Filed: Dec. 6, 1983

Related U.S. Application Data

[63] Continuation of Ser. No. 352,261, filed Feb. 25, 1982, now abandoned.

[30] Foreign Application Priority Data

Mar. 10, 1981 [JP] Japan ..... 56-34374
Mar. 25, 1981 [JP] Japan ..... 56-43431

[51] Int. Cl.[4] ..... G03G 9/08
[52] U.S. Cl. ..... 430/110; 430/111; 430/903
[58] Field of Search ..... 430/110, 904, 99, 903

[56] References Cited

U.S. PATENT DOCUMENTS 4,051,077 9/1977 Fisher ..... 430/110
4,288,517 9/1981 Arimatsu et al. ..... 430/110

FOREIGN PATENT DOCUMENTS 120041 9/1980 Japan ..... 430/110
128956 10/1981 Japan ..... 430/110

*Primary Examiner*—John L. Goodrow
*Attorney, Agent, or Firm*—Fitzpatrick, Cella, Harper & Scinto

[57] ABSTRACT

A developer comprises toner particles and flowability improver granules having a granule size of 0.1–20 times the average particle size of the toner particles. The developer has high durability, fixability and good developing characteristics.

14 Claims, No Drawings

DEVELOPER HAVING IMPROVED FLOW CHARACTERISTICS AND A PROCESS FOR PRODUCING SAME

This application is a continuation of application Ser. No. 352,261 filed Feb. 25, 1982 now abandoned.

BACKGROUND OF THE INVENTION

1. Field of the Invention

This invention relates to a developer for developing electric latent images or magnetic latent images in electrophotographic processes, electrostatic printing processes and the like, and a process for producing the developer.

2. Description of the Prior Art

Heretofore there have been known various electrophotographic processes such as those disclosed in U.S. Pat. No. 2,297,691, British Patent Nos. 1,165,406 and 1,165,405. These processes usually comprise utilizing a photoconductive material, forming electric latent images on a photosensitive member by some means, developing the latent images with a toner, if desired, transferring the developed toner images to a receiving sheet such as paper and then fixing the toner images by heat, pressure, or solvent vapor.

There are known various methods for visualizing electric latent images with a toner. For example, there may be mentioned magnetic brush development as described in U.S. Pat. No. 2,874,063, cascade development as described in U.S. Pat. No. 2,618,552, powder cloud development as described in U.S. Pat. No. 2,221,776, fur-brush development, liquid development and the like.

Developed toner images may be transferred to a receiving sheet and fixed, if desired.

As a method of fixing toner images, there may be mentioned a method comprising heating and melting toner particles by a heater or heat roller and fusing followed by solidifying on the support, a method for fixing toner particles to a supporting member by softening or melting the resin binder in toner particles with an organic solvent, a method for fixing toner particles to a supporting member by pressure, and the like.

Toners used for these development methods are heretofore fine powders composed of dyes or pigments dispersed in natural or synthetic resins. If desired, third components are added to the fine powders.

Materials for toner particles are selected in such a way that they are suitable for each particular fixing method. Therefore, a toner suitable for a particular fixing method is usually not usable for the other fixing methods.

In particular, a toner used for, conventional heat fusing fixing methods employing a heater is not likely to be used for a heat roller fixing method, a solvent fixing method, a pressure fixing method and the like. Therefore, toners suitable for each particular fixing method are researched and developed.

The method for fixing toners by pressure is for example, disclosed in U.S. Pat. No. 3,269,626. The method has various advantages, that is, less consumption of energy, non-pollution, copying without a waiting time by simply switching on a copying machine, no fear of burning and scorching copies, high speed fixing and a simple fixing device and the like.

However, the pressure fixing method has same disadvantages such as poor fixability of the toner, offsetting to the pressure roller, causing paper to wind on the pressure roller and the like. Therefore, researches have been made to improve the pressure fixation. For example, British Patent No. 1,210,665 discloses a pressure fixation toner containing an aliphatic component and a thermoplastic resin; U.S. Pat. Nos. 3,788,994 and 3,974,078, British Patent No. 1,431,699 and Japanese Patent Laid-open No. 108134/1977 disclose pressure fixable toners of a capsule type containing a soft material in the core; and British Patent No. 1,414,159 discloses a pressure fixable toner composed of a block copolymer derived from a sticky and strong polymer and a soft polymer.

However, any practically satisfactory pressure fixable toner has not been yet obtained which can be easily produced, has a sufficient pressure fixability, does not cause offsetting to the pressure roller, does not cause paper to wind on the pressure roller, is stable with repect to developing property and fixability upon repeated use, does not adhere to carrier, metal sleeve or the surface of the photosensitive member and has good storage stability, i.e. non-agglomerative and non-caking.

There has been recently used a method of developing electrostatic images with a one-component developer which has toner particles containing magnetic fine powder and does not use any carrier particles. In this method the toner binder resin is required to have good dispersibility and contacting property with respect to the magnetic fine powders and the toner particles are required to have high impact strength and fluidity.

One-component developers are proposed in U.S. Ser. No. 141,919 filed April 21, 1980 as a continuation application and U.S. Ser. No. 264,516 filed May 18, 1981 as a continuation application. When development is effected by triboelectric charging caused by friction between a one-component developer and a developing sleeve roller, the insulating material separates due to shock or a long time use, attaches to the sleeve roller by triboelectric action and accumulates, and thereby the developing durability is adversely affected. In this way, one-component developers suffer from various problems.

As shown in U.S. Pat. No. 3,775,326, Japanese Patent Publication No. 35867/1976, Japanese Patent Laid-Open No. 64931/1976, U.S. Pat. Nos. 4,022,738 and 4,108,653, it is known that polyethylene resin is a material having excellent pressure fixability. However, there are no known durable developers which reveal excellent pressure fixability even with a low pressure and can stand up to producing several ten thousand sheets of copy.

In pressure fixable toners, fixability contradicts developing durability. The larger the fixability, the poorer the flowability of toners, and thereby the developing durability becomes remarkably poor, and in an extreme case, after producing several copies only, any further reproduction becomes impossible. Toners capable of being fixed at a low pressure are desired for the purpose of avoiding curling of papers imparting, luster to papers and to accomodate changes in the thickness of paper.

In order to enhance the developing durability of pressure fixable toners, toner particles are mixed with a flowability improver. However, when fine particulates of a flowability improver having a size (about 5–50 mμ) far smaller than the particle size of the toner particle are used, the images produced at the beginning are good, but during repeated developing for copying, the fine particulates of the flowability improver become buried in the toner particles or separate from the toner particles, and as a result the flowability improver necessary for reproduction of images is liable to be lacking and therefore, the resulting image density is very low. Such undesirable phenomena seem to occur since the size of the flowability improver particulates is smaller than that of the toner and the hardness of the flowability improver particulates is harder than that of the toner. Such phenomena occur strongly when a pressure fixable toner capable of being fixed is used.

SUMMARY OF THE INVENTION

An object of the present invention is to provide a durable developer which has stable developing properties such as chargeability and the like and stable fixability when used repeatedly and a process for producing such a durable developer.

Another object of the present invention is to provide a developer which is of excellent pressure fixability and does not cause any offsetting to pressure rollers.

A further object of the present invention is to provide a developer which shows excellent properties as mentioned above when used as a magnetic developer and can be electrostatically transferred.

Still another object of the present invention is to provide a developer which does not adhere to the surfaces of a photosensitive member of a sleeve and has excellent storage stability such as causing neither agglomeration nor caking during storage, and a process for producing such a developer.

According, to one aspect of the present invention, there is provided a developer which comprises toner particles, flowability improver granules having a granule size of 0.1–20 times the average particle size of the toner particles, and if desired, primary particles of a flowability improver.

According to another aspect of the present invention, there is provided a process for producing a developer which comprises mixing flowability improver granules and toner particles by means of a mixer that does not utilized shearing force.

According to a further aspect of the present invention, there is provided a process for producing a developer which comprises a step for mixing toner particles and primary particles of a flowability improver having an average particle size smaller than the average particle size of the toner particles, or flowability improver granules by means of a mixer utilizing shearing force, and a step for mixing the resulting mixture in the above, step and flowability improver granules by means of a mixer that does not utilize shearing force.

DESCRIPTION OF THE PREFERRED EMBODIMENTS

According to the present invention, the developer contains granules of a flowability improver. The granules of a flowability improver may be produced by gathering together of original fine particulates of the flowability improver. The "original fine particulates" are often called "primary particles" in this invention.

During repeated copying, the developer is stirred in a developing vessel so that each fine particulate of the flowability improver is gradually released from the flowability improver granules, and therefore, there exists always a certain amount of discrete fine particulates of the flowability improver in the developer thereby in enhancing remarkably the durability of the developer.

As a flowability improver used in the present invention, there may be used colloidal silica, alumina powders and the like, and the average particle size of the primary particle is preferably 5–100 mμ.

Flowability improver granules may be produced by gathering together original fine particulates of a flowability improver alone by a conventional method or solidifying said fine particulates with a resin.

As the resin, there may be used natural or synthetic resins. Examples of the resin are: homopolymers or copolymers of styrene or substituted styrenes, polyvinyltoluene, epoxy resins, polyester resins, acrylic resins, xylene resins, polyamide resins, ionomer resins, furan resins, ketone resins, terpene resins, phenol modified terpene resins, rosin, rosin modified pentaerythritol esters, natural resin modified phenolic resins, natural resin modified maleic acid resins, coumarone-indene resins, maleic acid modified phenolic resins, alicyclic hydrocarbon resins, petroleum resins, cellulose acetate phthalate, methyl vinyl ether-maleic anhydride copolymers, starch graft polymers, polyvinyl butyral, polyvinyl alcohol, polyvinyl pyrrolidone, chlorinated paraffin, cyclized rubber, waxes, fatty acids and the like. These resins may be used alone or in combination. These resins may be dissolved in solvents and a flowability improver is added thereto, mixed and the resulting mixture is dried followed by grinding to produce the granules. It is preferable to solidify softly since such softly solidified flowability improver particulates are easily released to enhance the durability of the developer.

The weight ratio of the flowability improver to the resin is preferably 100 parts by weight to 0.1–100 parts by weight, more preferably 100 parts by weight to 0.5–80 parts by weight.

The granule size of the flowability improver granules is 0.1–20 times, preferably 1–20 times, more preferably 5–15 times the average particle size of the toner. When the granule size is less than 0.1 times the average particle size of the toner, the durability of developer is not sufficient. On the contrary, when the granule size is larger than 20 times the average particle size of the toner, stripes (attributable to non-uniform distribution of the toner, that is, uniform distribution of the toner is disturbed) appear on a developing sleeve of a developing device.

The desired granule size of the flowability improver may be obtained by grinding and classifying, if necessary.

The content of the flowability improver granules in a developer is preferably 0.1–10 parts by weight, more preferably 0.3–3 parts by weight of the flowability improver granules per 100 parts by weight of the toner. Where the content of the flowability improver granules is less than 0.1 part by weight per 100 parts by weight of the toner, the durability of developing is not sufficient while where the content is more than 10 parts by weight per 100 parts by weight of the toner, the fixability is low.

Toner particles may comprise a binder, a colorant, and if desired, magnetic particles and additives. Average particle size of toner particles is preferably 5–30 μ, more preferably, 10–15 μ.

As a binder, a material capable of being easily fixed to fibers of paper when pressed thereto is preferable. Particularly preferable binders are: ethylenic polymers having a melt viscosity of $10–10^6$ cps at 140° C. such as polyethylene, polypropylene, ethylene-propylene copolymers, ethylene-acrylic copolymers, ethylene-vinyl acetate copolymer and the like; rubbers such as styrene-isoprene copolymers, styrene-butadiene copolymers and the like; elastomers such as polyurethane elastomers, saturated linear polyesters and the like; fatty acids and derivatives thereof such as stearic acid, oleic acid, myristic acid, stearamide, oleoamide, zinc stearate and the like; and waxes such as paraffin wax, carnauba wax and the like.

As a colorant, there may be used conventional dyes and pigments such as carbon black, iron black, phthalocyanine blue, ultramarine, quinacridone, benzidine yellow, and the like.

When magnetic toners are required, magnetic powders may be incorporated in the toners. The magnetic powders are, for example, ferromagnetic elements such as iron, cobalt, nickel, manganese and the like, alloys or compounds containing such ferromagnetic element such as magnetite, hematite, ferrite and the like, and other conventional ferromagnetic alloys known as a magnetic material. The magnetic powders may also function as a colorant.

In addition, for the purpose of charge controlling, inhibiting agglomeration and the like, there may be added nigrosine, metal complex, colloidal silica powder, fluorine containing resin powder or the like.

According to the process for producing the developer of the present invention, toner particles and the flowability improver granules are mixed by means of a mixer which does not use shearing force. The developer thus produced is preferable as a developer according to the present invention.

In order to improve the initial characteristics of the developer, it is preferable that both primary particles and granules of a flowability improver are incorporated in the developer. In this case, the developer may be produced by carrying out a step for mixing toner particles and primary particles of a flowability improver having an average particle size smaller than the average particle size of the toner particles by means of a mixer utilizing shearing force, and a step for mixing the resulting mixture in the above step and flowability improver granules by means of a mixer that does not use shearing force.

The initial mixing ratio of the primary particles of the flowability improver to the toner particles is 0.01–10 parts by weight, preferably 0.1–8 parts by weight, to 100 parts by weight.

Alternatively, for the purpose of obtaining the desired initial mixing ratio of the primary particles of the flowability improver to the toner particles, the toner particles and the flowability improver granules (the average granule size of the flowability improver is preferably smaller than the average particle size of the toner) may be mixed by a mixer utilizing shearing force to disintegrate the flowability improver granules into primary particles.

When the above mentioned mixing methods are employed, toner particles and primary particles of the flowability improver in the developer are sufficiently mixed even at the initial stage of developing and as a result, formation of irregular images can be prevented, and further undesirably high image density and poor pressure fixability caused when the amount of the primary particles of a flowability improver can be prevented.

What is meant by "a mixer utilizing shearing force" is, for example, a mixer provided with vanes for stirring inside thereof, and rotating the vanes results in mixing particles. An effective uniform mixing can be conducted within a short time, but the shape of the particle is changed or the particle is broken depending upon the mixing conditions. Some examples of commercially available mixers utilizing shearing force and their operation conditions are as shown below: "Henschell Mixer", manufactured by Mitsui Miike Machinery Co., Ltd., mixing for 1–5 minutes, preferably 2–4 minutes; "Mini Emide Crusher" manufactured by Shibata Chemical Apparatus Mfg. Co., Ltd., mixing for 15–60 sec., preferably 20–40 sec.; and "Nauta Mixer", manufactured by Hosokawa Micron.

What is meant by "a mixer does not utilize shearing force" is, for example, a mixer which is not provided with any stirring vanes, but the vessel of the mixer itself vibrates in vertical or lateral direction or rotates to mix particles. Uniform mixing can be softly effected so that change of particle shape and breaking of particles hardly occurs. Commercially available mixers that do not use shearing force are:

for example, a ball-mill without balls;

Twin Shell Mixer manufactured by Tokuji Kosakusho Co., Ltd.;

Turbula Mixer manufactured by Shinmaru Enterprises Corporation, mixing for 30 sec.–3 min., preferably 1–2 min.;

Paint Shaker manufactured by Red Devil. Rotation of a mixing vessel may be effected manually.

The following examples are given for illustrating the present invention. Parts are by weight unless otherwise indicated.

EXAMPLE 1

Polymer produced by dissolving 20 parts of ethyleneethyl acrylate copolymer and 30 parts of castor wax in 50 parts of monomers composed of styrene and butyl methacrylate

| | |
|---|---|
| (30 parts:20 parts) and polymerizing | 100 parts |
| Metal complex dye (as a charge controlling agent) | 2 parts |
| magnetite | 50 parts |

A mixture of the above ingredients was kneaded at 130° C. by means of a roll mill, cooled, pulverized and classified by a zigzag classifier to obtain toner particles having an average particle size of 12.5 μ.

60 g. of primary particles of hydrophobic colloidal silica ("R 972", tradename, supplied by Nippon Aerosil Co., Japan) was added to 100 ml of a 2% solution of a styrenebutyl acrylate-maleic anhydride resin ("X-4 resin", tradename, supplied by Daido Kogyo-sha, Japan) in methyl ethyl ketone, stirred, and the resulting gel-like material was placed in a vat and air-dried. After air-drying, the material was ground in a mortar to obtain an average granule size of 125 μ of flowability improver granules.

1.2 parts of the flowability improver granules was mixed with 100 parts of the above mentioned toner particles for 1 minute by means of a mixer that does not use shearing force to produce a developer. The resulting developer was placed in an electrophotographic copier ("NP 120", tradename, manufactured by CANON K.K., the fixing pressure being a line pressure of 25 kg/cm) and the copying durability of the toner was measured. The maximum density of images from the beginning to the 100,000th copy was 1.2±0.2 and the images were sharp and clear.

For comparison, the primary particles of the hydrophobic colloidal silica without granulation were mixed with the toner in a way similar to the above procedure, and copying was effected by using the above mentioned electrophotographic copier. There were able to be produced only about 100 sheets of copy having sharp and clear images.

EXAMPLE 2

| | |
|---|---|
| Polyethylene wax | 50 parts |
| Paraffin (m.p. 70° C.) | 50 parts |
| Metal complex dye (as a charge controlling agent) | 2 parts |
| Magnetite | 50 parts |

A mixture of the above mentioned ingredients was kneaded at 130° C. by means of a roll mill, cooled, pulverized and classified by a zigzag classifier to obtain toner particles having an average particle size of 10 μ.

Flowability improver granules were produced in a way similar to Example 1 above.

100 parts of the toner particles and 2 parts of the flowability improver granules were mixed to produce a developer. The copying durability of the developer was tested by using the same electrophotographic copier as in Example 1. The maximum density of images from the beginning to the 3,000th copy was 1.4±0.3, and the images were sharp and clear, and the fixation was effected at a line pressure of 10 Kg/cm.

For comparison, the primary particles of the hydrophobic colloidal silica without granulation were mixed with the toner in a way similar to the above procedure, and copying was effected by using the above mentioned copier. The image density became very low even when the third copy was produced.

EXAMPLE 3

The toner in Example 1 was used.

Flowability improver granules were prepared by the following procedure.

100 g. of colloidal silica ("HDK H-15", tradename, supplied by Wacker Co.) was added to 100 ml of a 1% solution of a cyclized rubber ("Alpex CK450", tradename, supplied by Hoechst) in toluene, stirred, and the resulting gel-like material was placed in a vat to air-dry at 50° C., and then, ground in a mortar to obtain flowability improver granules having an average granule size of 160 μ.

The resulting flowability improver granules (1.0 part) was mixed with 100 parts of the toner of Example 1 to prepare a developer.

The developer thus prepared was tested with respect to copying durability by using the electrophotographic copier as used in Example 1. The maximum image density from the beginning to the 100,000th copy was 1.3±0.2, and the images were sharp and clear.

EXAMPLE 4

100 parts of toner of Example 1 and 0.6 part of colloidal silica ("Aerosil R972", tradename, supplied by Nippon Aerosil Co., Japan) were mixed for 30 sec. by means of a mixer utilizing shearing force (Mini Emide Crusher, manufactured by Shibata Chemical Apparatus Mfg. Co., Ltd., Japan). Then, 0.8 part of flowability improver granules of Example 1 was added to the mixture produced as above and mixed for one minute by means of a mixer without utilizing shearing force (a small twin shell mixer manufactured by Canon K. K.) to produce a developer.

The developer was placed in an electrophotographic copier ("NP 120", tradename, manufactured by Canon K. K., the fixing pressure being a line pressure of 25 Kg/cm) and the copying durability was tested. The maximum image density from the beginning to the 100,000th copy was 1.32±0.2 and the images were sharp and clear.

For comparison, the toner particles, the colloidal silica (as primary particles of a flowability improver) and the flowability improver particles were directly mixed by means of a mixer utilizing shearing force, or were directly mixed by means of a mixer that does not utilze shearing force to produce developers. The resulting developers gave irregular images and less fixability, that is, poor image quality and fixability when used for developing latent images.

EXAMPLE 5

100 parts of toner particles of Example 2 and 0.8 part of colloidal silica ("Aerosil R972", tradename, manufactured by Nippon Aerosil Co., Japan) were mixed for 3 minutes by a mixer utilizing shearing force ("Henschel Mixer FM-10B", tradename, manufactured by Mitsui Miike Machinery Co., Ltd., Japan) at 2460 rpm. The resulting mixture was mixed with 1.0 part of flowability improver granules of Example 1 by a mixer that does not use shearing force (a twin shell mixer, manufactured by Tokuju Kosakusho Co., Ltd. Japan) for 30 sec. to obtain a developer.

The resulting developer was subjected to the test for copying durability conducted by the electrophotographic copier as used in Example 1. The maximum image density from the beginning to the 3000th copy was 1.53±0.3 and the resulting images were sharp and clear and were fixed at a line pressure of 10 Kg/cm.

What we claim is:

1. A one-component developer which comprises toner particles and flowability improver granules; said granules each comprising a plurality of primary flowability improver particles, said flowability improver granules having a granule size of 1–20 the average particle size of the toner particles, and said primary flowability improver particles having an average particle size smaller than the average particle size of the toner particles; wherein said granules are capable of releasing said primary flowability improver particles over a continued period of use.

2. A one-component developer according to claim 1 wherein the average particle size of the primary flowability improver particles is 5–100 μm.

3. A one component developer according to claim 1 wherein the flowability improver is colloidal silica or alumina.

4. A one-component developer according to claim 1 wherein the amount of the flowability improver granules is 0.1–10 parts by weight per 100 parts by weight of the toner particles.

5. A one-component developer which comprises toner particles, primary flowability improver particles and flowability improver granules; said granules each comprising a plurality of primary flowability improver particles, said flowability improver granules having a granule size of 1–20 times the average particle size of the toner particles, and said primary flowability improver particles having an average particle size smaller than the average particle size of the toner particles; wherein said granules are capable of releasing said primary flowability improver particles over a continued period of use.

6. A one-component developer according to claim 5 wherein the amount of the primary flowability improver particles is 0.01–10 parts by weight per 100 parts by weight of the toner particles.

7. A process for producing a one-component developer which comprises mixing by means of a mixer without utilizing shearing force (a) flowability improver granules comprised of primary flowability improver particles for continued release of said primary particles in the developer and (b) toner particles; said primary flowability improver particles having an average particle size smaller than the average particle size of the toner particles.

8. A process according to claim 7 wherein the flowability improver granules have an average granule size 1–20 times the average particle size of the toner particles.

9. A process for producing a developer which contains flowability improver granules for continued release of its primary flowability improver particles comprising the steps of:

(a) mixing toner particles and primary particles of a flowability improver having an average particle size smaller than the average particle size of the toner particles by means of a mixer utilizing shearing force to form a mixture; and (b) mixing said mixture with flowability improver granules by means of a mixer without utilizing shearing force; said granules each comprising a plurality of primary flowability particles capable of being released in the developer over a continued period of use.

10. A process according to claim 9 wherein in step (a) 100 parts by weight of toner particles and 0.01–10 parts by weight of primary flowability improver particles are mixed by means of a mixer utilizing shearing force.

11. A process according to claim 9 wherein in step (b) the flowability improver granules have an average granule size larger than the average particle size of the toner particles.

12. A process for producing a developer which contains flowability improver granules for continued release of its primary flowability improver particles comprising the steps of:

(a) mixing toner particles and flowability improver granules by means of a mixer utilizing shearing force to form a mixture; and (b) mixing said mixture with flowability improver granules by means of a mixer without utilizing shearing force; said granules each comrising a plurality of primary flowability particles capable of being released in the developer over a continued period of use.

13. A process according to claim 12 wherein in step (a) the average granule size of the flowability improver granules is larger than the average particle size of the toner particles.

14. A process according to claim 12 or 13 wherein in step (b) the flowability improver granules have an average granule size larger than the average particle size of the toner particles.

* * * * *

UNITED STATES PATENT AND TRADEMARK OFFICE

CERTIFICATE OF CORRECTION

PATENT NO. : 4,555,467

DATED : November 26, 1985

INVENTOR(S) : TETSUO HASEGAWA, ET AL.

It is certified that error appears in the above-identified patent and that said Letters Patent is hereby corrected as shown below:

COLUMN 8

Line 44, "1-20 the" should read --1-20 times the--.

COLUMN 10

Line 21, "comrising" should read --comprising--.

Signed and Sealed this

Tenth Day of March, 1987

*Attest:*

DONALD J. QUIGG

*Attesting Officer*

*Commissioner of Patents and Trademarks*